US006920924B2

(12) United States Patent
Roesch et al.

(10) Patent No.: US 6,920,924 B2
(45) Date of Patent: Jul. 26, 2005

(54) WELLBORE APPARATUS

(75) Inventors: Mark A. Roesch, Brecksville, OH (US); Dennis P. Revlock, Sr., Medina, OH (US); Stevan Joe White, Richardson, TX (US)

(73) Assignee: The Lamson & Sessions Co., Cleveland, OH (US)

( * ) Notice: Subject to any disclaimer, the term of this patent is extended or adjusted under 35 U.S.C. 154(b) by 101 days.

(21) Appl. No.: 10/448,167

(22) Filed: May 29, 2003

(65) Prior Publication Data

US 2004/0238183 A1 Dec. 2, 2004

(51) Int. Cl.[7] ..... E21B 19/089
(52) U.S. Cl. ..... 166/71; 166/241.6; 166/242.3
(58) Field of Search ..... 166/71, 162, 206, 166/241.1, 241.6, 242.3

(56) References Cited

U.S. PATENT DOCUMENTS

| | | | |
|---|---|---|---|
| 5,533,356 A | 7/1996 | DeMasters | |
| 5,590,715 A | 1/1997 | Amerman | |
| 5,639,184 A | 6/1997 | DeMasters | |
| 5,642,964 A | 7/1997 | DeMasters | |
| 5,758,724 A | 6/1998 | Amerman | |
| 6,041,862 A | 3/2000 | Amerman | |
| 6,250,371 B1 | 6/2001 | Amerman et al. | |
| 6,276,438 B1 | 8/2001 | Amerman et al. | |
| 6,585,036 B2 | 7/2003 | Amerman et al. | 165/45 |
| 6,672,371 B1 | 1/2004 | Amerman et al. | 165/45 |

OTHER PUBLICATIONS

Vanguard Piping Systems web page at http://www.vanguardpipe.com/geo.html, printed on three sheets, copyright 2004.

Chevron Phillips Chemical web page at http://www.cpchem.com/docs/PP650.pdf entitled "Performance Pipe", pp. 1–8, dated Feb. 2002.

*Primary Examiner*—Zakiya Walker
(74) *Attorney, Agent, or Firm*—Jones Day

(57) ABSTRACT

A unitary pipe loop component for use with a sinker bar and a pair of pipes in a wellbore includes a return bend pipe fitting having a fluid flow passage configured to extend between the pipes in the wellbore, and further includes a sleeve having a passage with open opposite ends to receive the sinker bar through the sleeve. A weight suspension structure is connected to the sleeve and the pipe fitting as another distinct portion of the unitary pipe loop component, and has a knockout portion configured to provide an eyelet for insertion of a hook, tether, or the like for suspension of a weight. The eyelet may alternatively receive an anchor.

27 Claims, 6 Drawing Sheets

WELLBORE APPARATUS

FIELD OF THE INVENTION

This invention is directed to pipe loops that are installed in wellbores.

BACKGROUND OF THE INVENTION

A pipe loop may be installed in a wellbore that is drilled into the earth. It is often necessary to add weight to the pipe loop in order to sink the pipe loop in the wellbore. The weight may be provided by one or more metal sinker bars that are connected to the pipe loop. Such sinker bars may comprise rebars that are taped to the pipe loop. Alternatively, a cut piece of pipe may be taped to the pipe loop to serve as a sleeve for inserting a sinker bar. The sinker bar can be removed from the sleeve and raised from the wellbore by the use of a tether when the pipe loop has been installed.

SUMMARY OF THE INVENTION

The invention provides a unitary pipe loop component for use with a sinker bar and a pair of pipes in a wellbore. The unitary pipe loop component includes a return bend pipe fitting with a fluid flow passage configured to extend between the pipes. The unitary pipe loop component further includes a sleeve having a passage with open opposite ends to receive the sinker bar through the sleeve.

In a preferred embodiment of the invention, the unitary pipe loop component is a one-piece molded plastic part configured for connection to the pair of pipes solely at the lower end surfaces of the pipes. The sleeve in the preferred embodiment has an inner surface with an undulating contour, and further has inclined upper and lower end surfaces.

The preferred embodiment of the invention further includes a weight suspension structure which is connected to the sleeve and the pipe fitting as another distinct portion of the one-piece molded plastic part. This structure has a knockout portion that provides an eyelet for insertion of a hook, tether, or the like for suspension of a weight from the pipe loop component. The eyelet may alternatively receive an anchor for the pipe loop component.

DESCRIPTION

Figure 1:
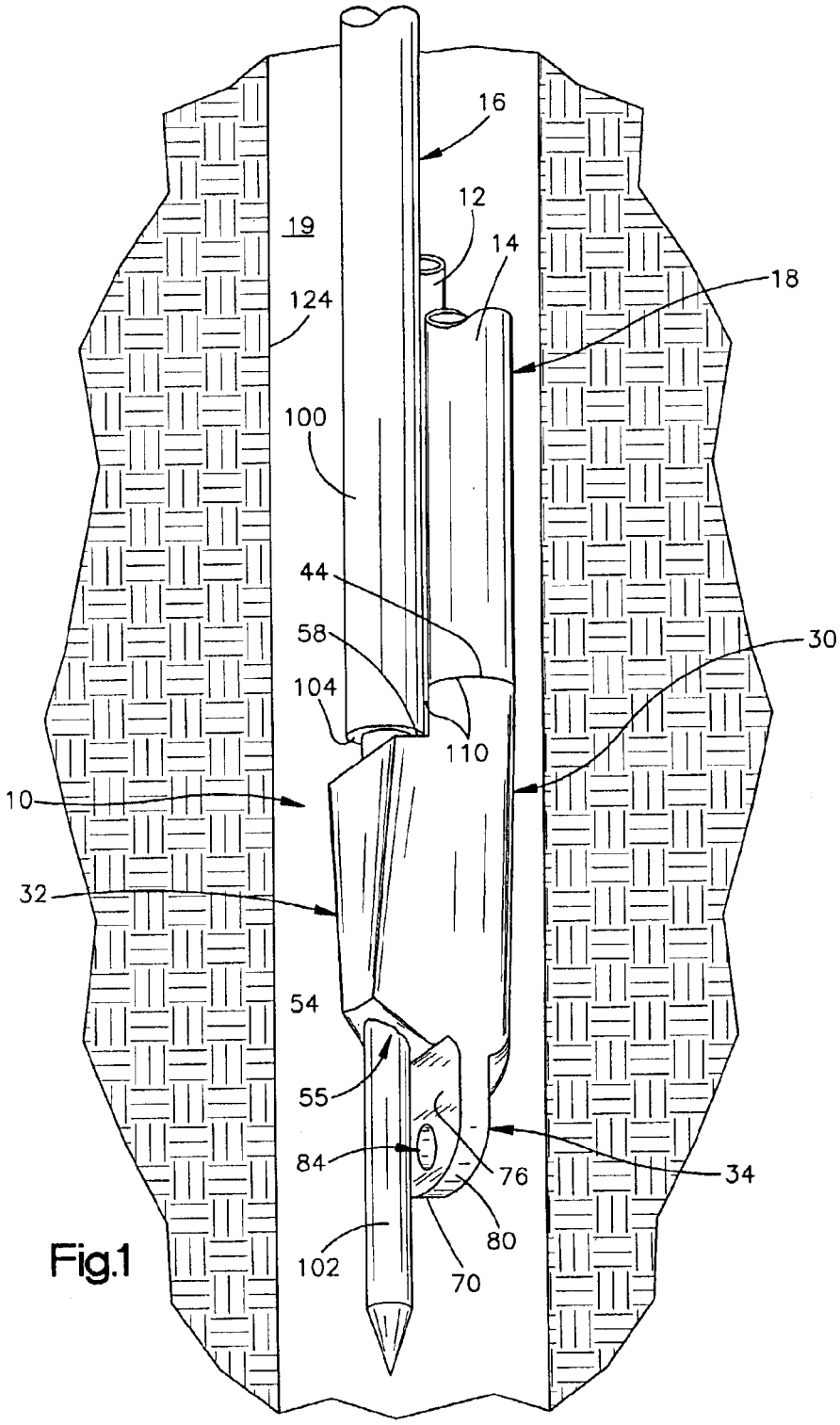
FIG. 1 is a perspective view of parts of a wellbore apparatus in a wellbore.

The apparatus shown in FIG. 1 has parts which, as described below, are examples of the parts recited in the claims. These include a unitary pipe loop component 10, a pair of polyethylene pipes 12 and 14, and a metal sinker bar 16. The component 10 defines the lower end of a pipe loop 18 that includes the two pipes 12 and 14. The sinker bar 16 applies a weight load that forces the component 10 downward in a wellbore 19 for installation of the pipe loop 18 in the wellbore 19.

Distinct portions of the pipe loop component 10 are configured as distinct elements of the invention. For example, a first portion of the component 10 is configured as a return bend pipe fitting 30. A second portion of the component 10 is configured as a sleeve 32 for receiving the sinker bar 16. A third portion is configured as a weight suspension structure 34.

This example of the unitary pipe loop component 10 is a one-piece molded plastic part. The plastic material in this embodiment is polyethylene. By "unitary" it is meant that the component 10 includes the distinct portions 30, 32 and 34 as interconnected parts of a single coherent structure which is configured for connection to the pipes 12 and 14, as shown in FIG. 1, but which is otherwise separate from the pipes 12 and 14. "One-piece" further specifies that the component 10 is a continuous body of the molded plastic material, and does not include separately molded pieces of plastic material that are joined together. These examples of the claimed pipe fitting 30, sleeve 32, and weight suspension structure 34 are thus connected to each other separately from the pipes 12 and 14 as contiguous portions of the one-piece component 10.

Figure 7:
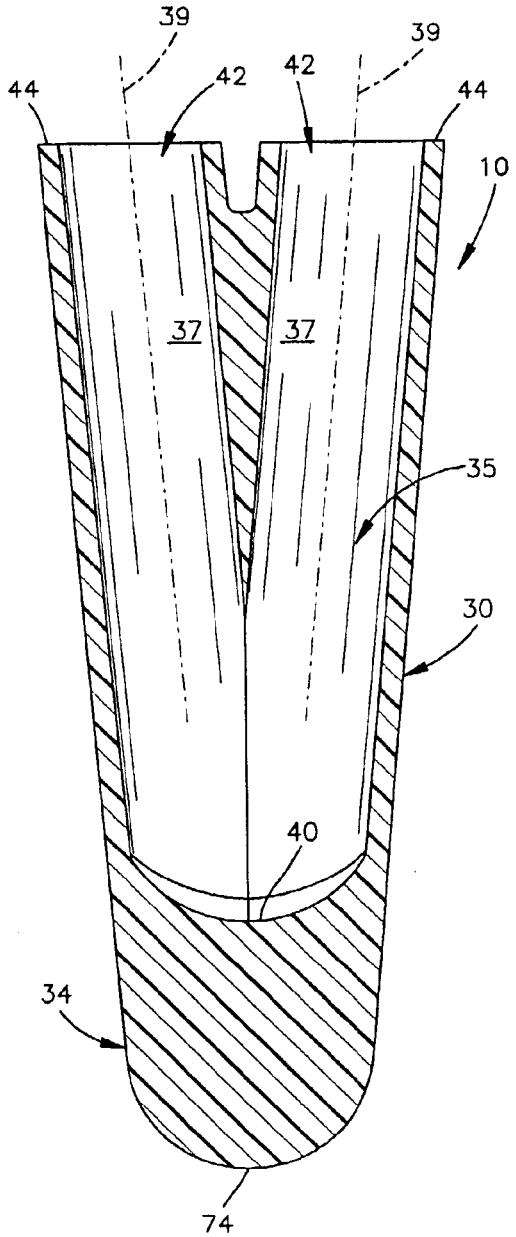
FIG. 7 is a sectional view taken on line 7—7 of FIG. 5.

As best shown in FIG. 7, the pipe fitting 30 has a V-shaped fluid flow passage 35 with two vertically elongated sections 37. The sections 37 of the passage 35 are alike, and are centered on axes 39 that converge toward the lower end 40 of the passage 35. The two upper ends 42 of the passage 35 are defined by a corresponding pair of annular upper end surfaces 44 of the pipe fitting 30. The upper end surfaces 44 are coplanar, and lie in a horizontal plane when the component 10 is upright, as shown in the drawings.

Figure 3:
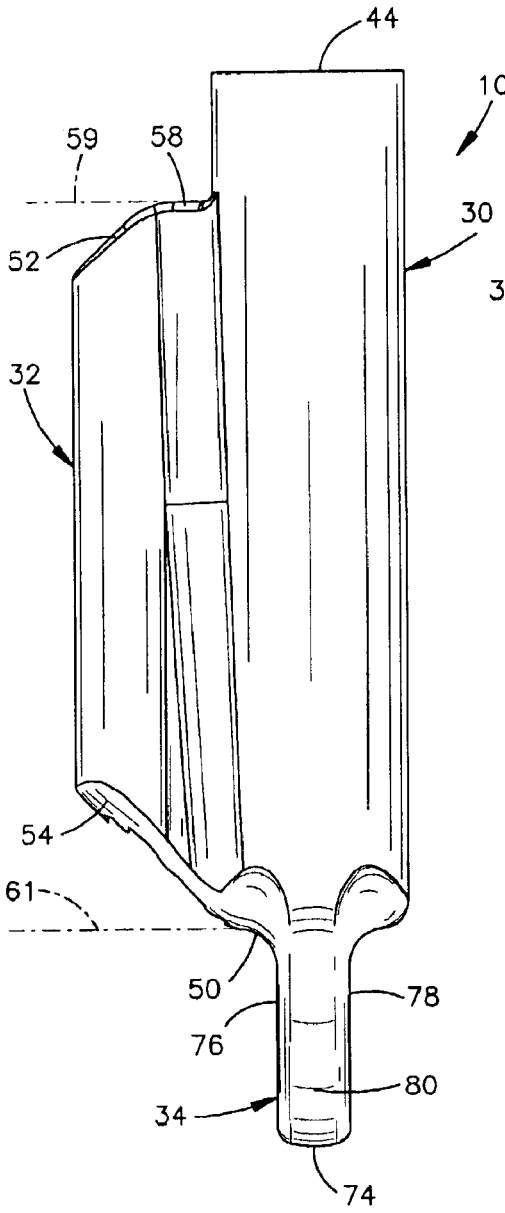
FIG. 3 is a side view taken on line 3—3 of FIG. 2.

The sleeve 32 is located at the front of the component 10 vertically between the upper and lower ends 44 and 50 of the pipe fitting 30. A vertically elongated passage 51 extends through the sleeve 32. This passage 51 is separate from the fluid flow passage 35 in the pipe fitting 30, and is configured to receive the sinker bar 16, as shown in FIG. 1. An edge surface 52 at the upper end of the sleeve 32 defines the open upper end 53 of the passage 51. Another edge surface 54 at the lower end of the sleeve 32 similarly defines the open lower end 55 of the passage 51. Each of these edge surfaces 52 and 54 has a contour that is inclined from a horizontal plane. More specifically, the upper edge surface 52, which faces upward, has a horizontal shoulder portion 58 but slopes downward from the plane 59 of the shoulder portion 58, as shown in FIG. 3. The lower edge surface 54, which faces downward, slopes upward from a horizontal plane 61, also as shown in FIG. 3.

Figure 4:
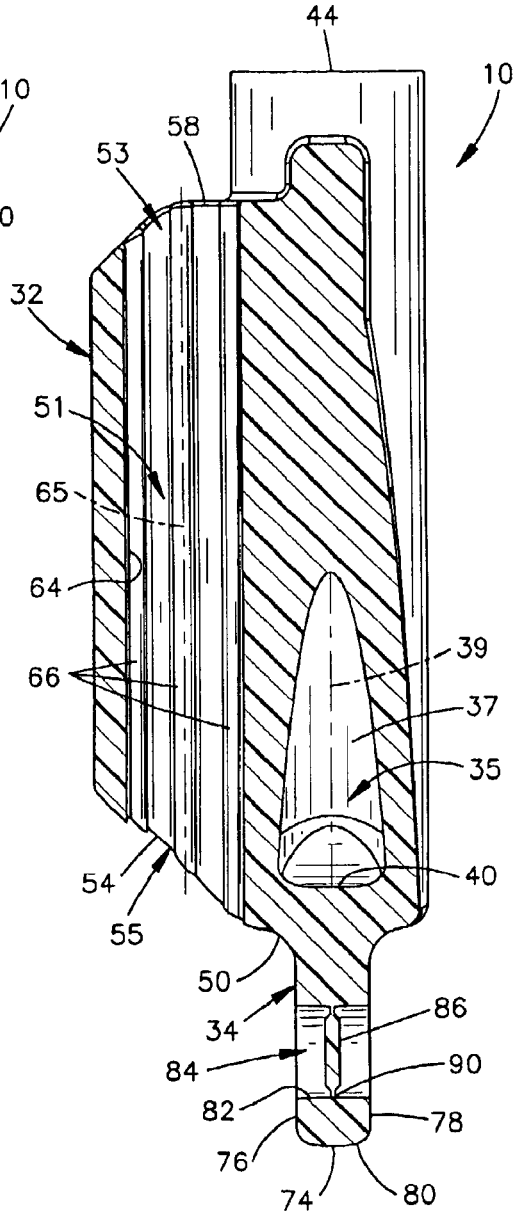
FIG. 4 is a sectional view taken on line 4—4 of FIG. 2.
Figure 5:
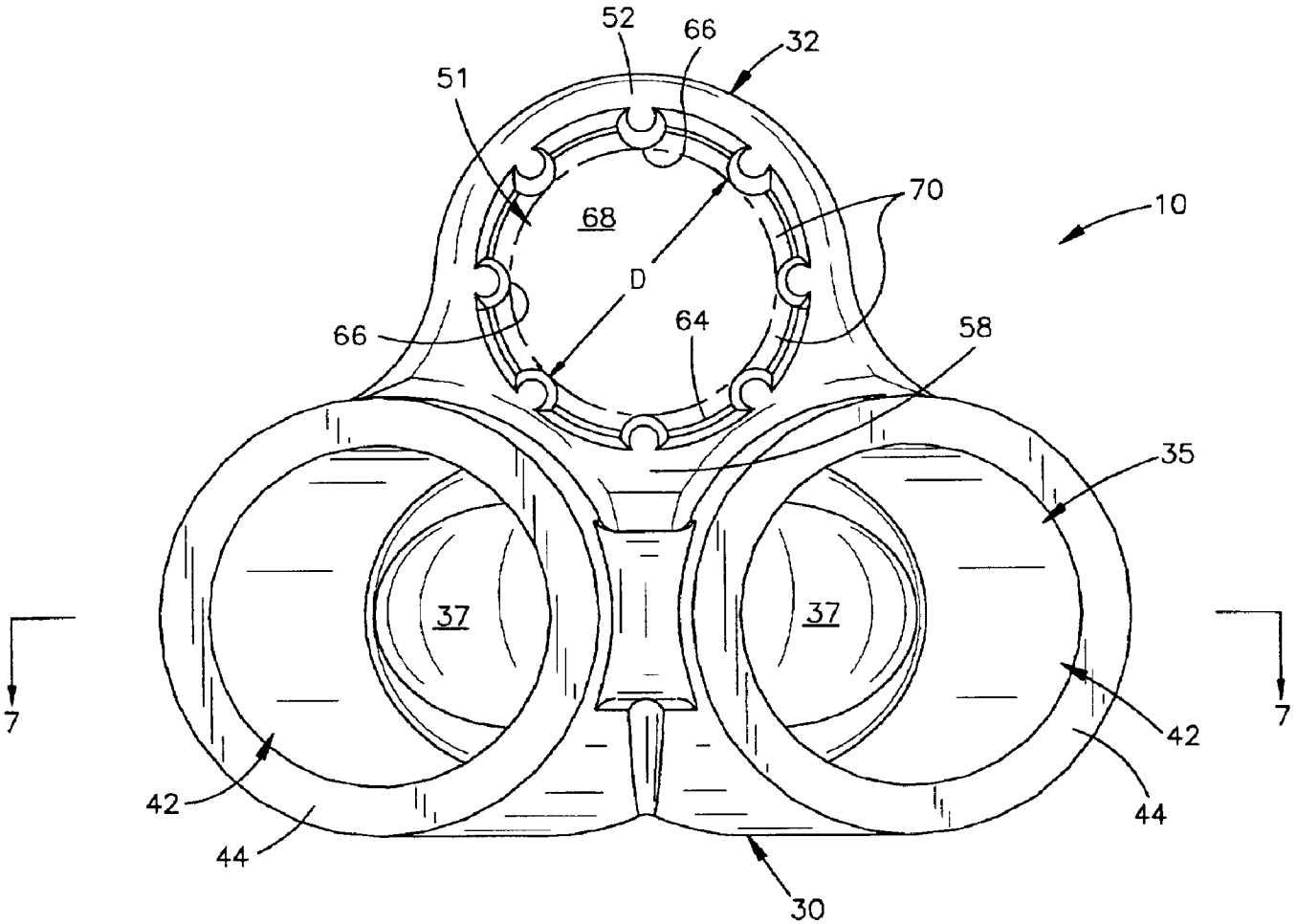
FIG. 5 is a top view taken on line 5—5 of FIG. 2.
Figure 6:
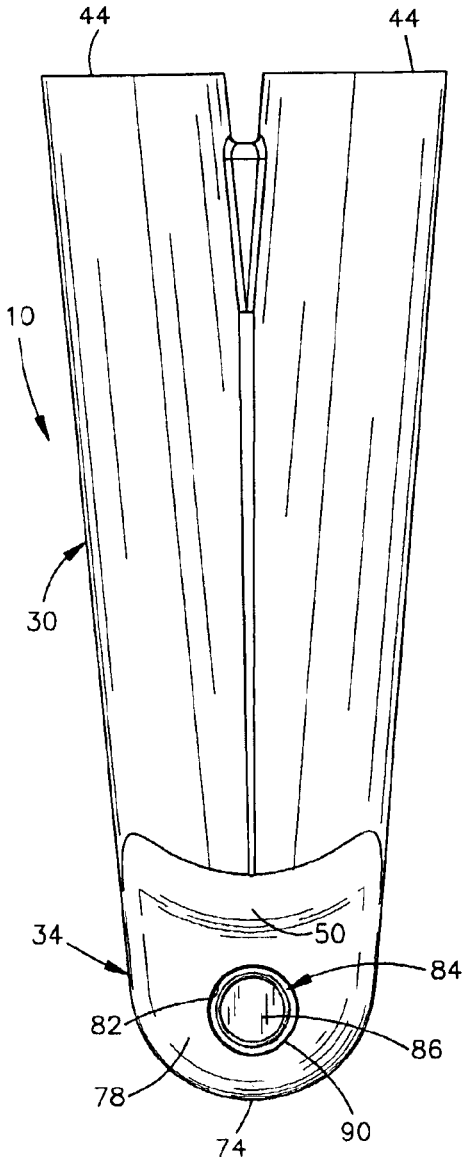
FIG. 6 is a rear view of the part as shown in FIG. 3.

A generally cylindrical inner surface 64 of the sleeve 32 is centered on a vertical axis 65, as shown in FIG. 4, and extends fully between the open opposite ends 53 and 55 of the passage 51. As best shown in FIG. 5, the inner surface 64 has an undulating contour defining ribs 66 that project radially inward at the periphery of the passage 51. The ribs 66 extend lengthwise of the passage 51, and are parallel and equally spaced apart from each other circumferentially about the axis 65. Accordingly, the passage 51 has a cylindrical center region 68 located radially inward of the ribs 66. In the illustrated example, the central region 68 has a diameter D (FIG. 5) defined by and between pairs of diametrically opposed ribs 66. The passage 51 further has a plurality of separate peripheral regions 70, each of which is shaped as a cylindrical segment extending circumferentially between a respective pair of adjacent ribs 66.

Figure 2:
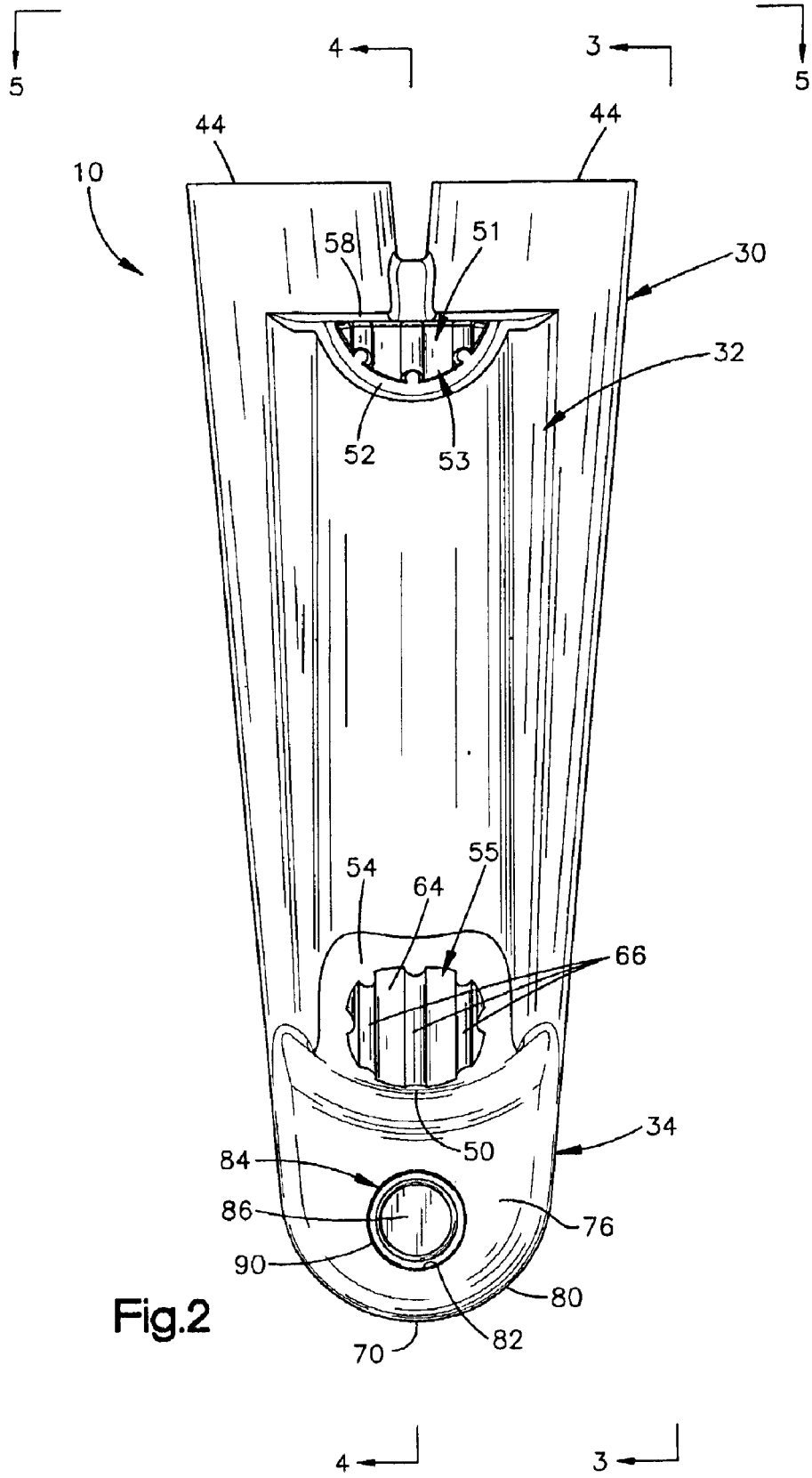
FIG. 2 is a front view of a part of the apparatus of FIG. 1.

The weight suspension structure 34 projects downward from the lower end 50 of the pipe fitting 30, and has a lower end 74 that defines the lower end of the component 10. As shown in FIGS. 3 and 4, the weight suspension structure 34 is a relatively narrow, flattened portion of the component 10 with planar front and back surfaces 76 and 78. A generally U-shaped peripheral edge surface 80 of the weight suspension structure 34 (FIG. 2) extends around the lower end 74.

Figure 8:
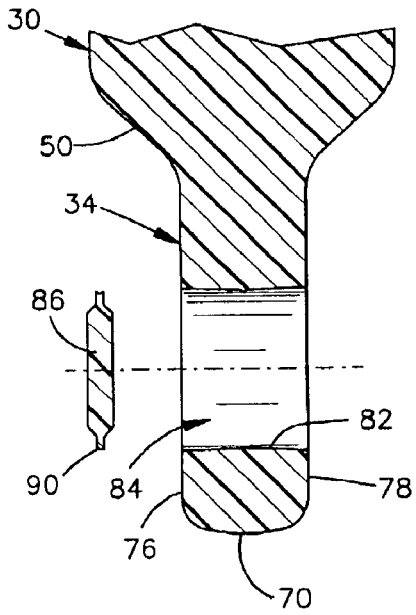
FIG. 8 is a partial sectional view of the part as shown in FIG. 4.

As further shown in FIG. 4, a cylindrical inner surface 82 of the weight suspension structure 34 defines a bore 84 that extends along a horizontal axis 85 between the front and back surfaces 76 and 78. A disc-shaped knockout 86 extends diametrically across the middle of the bore 84. A peripheral web portion 90 of the knockout 86 is thin enough to rupture under the impact of a hand tool against the knockout 86. This provides an opening through the middle of the bore 84 when the knockout 86 is detached from the weight suspension structure, as shown in FIG. 8.

Figure 9:
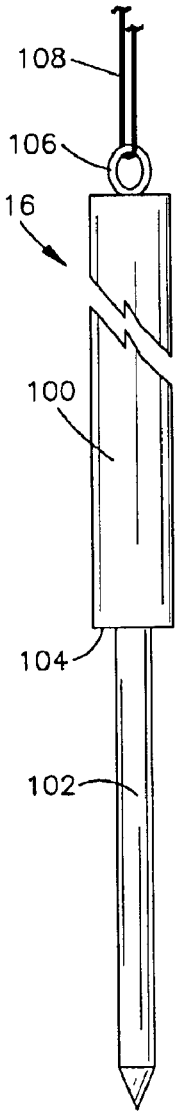
FIG. 9 is a view of another part of the apparatus of FIG. 1.

The sinker bar 16 is a known device, and is shown separately in FIG. 9. An upper section 100 of the sinker bar 16 provides most of the weight load noted above with reference to FIG. 1. A lower section 102 of the sinker bar 16 has a lesser diameter, and projects downward from an annular shoulder surface 104 on the upper section 100. A ring 106 at the top of the sinker bar 16 enables the attachment of a tether 108 for hoisting and lowering the sinker bar 16 in the wellbore 19.

Before the parts of FIG. 1 are lowered into the wellbore 19, the pipes 12 and 14 are attached to the component 10. Specifically, the lower end surfaces 110 (FIG. 1) of the pipes 12 and 14 are butt-welded to the component 10 at the upper end surfaces 44 (FIG. 7) of the pipe fitting 30. The lower section 102 of the sinker bar 16 is then inserted downward through the passage 51 in the sleeve 32 until the shoulder surface 104 on the sinker bar 16 moves into abutment with the shoulder surface portion 58 (FIG. 4) of the sleeve 32. The sinker bar 16 then rests on the component 10 to apply a weight load that forces the pipe loop 18 downward in the wellbore 19. When the pipe loop 18 has been placed in an installed position in the wellbore 19, the sinker bar 16 can be withdrawn from the sleeve 32 and lifted from the wellbore 19 by the tether 108.

Certain structural features of the sleeve 32 are configured to assist installation of the pipe loop 18 in the wellbore 19. For example, the inclined contours of the upper and lower edge surfaces 52 and 54 help the component 10 slide upward and downward, respectively, past clumps of earth or other obstructions in the wellbore 19. Additionally, the diameter D of the central region 68 of the passage 51 is preferably equal to the diameter of the lower section 102 of the sinker bar 16. This enables the sinker bar 16 to be fitted firmly within the passage 51. The peripheral regions 70 of the passage 51 provide clearance for earthen debris that might otherwise block or inhibit movement of the sinker bar 16 into and out of the passage 51.

The weight suspension structure 34 also is configured to assist installation of the pipe loop 18 in the wellbore 19. The open bore 84 (FIG. 8) can serve as an eyelet for receiving a tether, hook, or any other suitable attachment structure (not shown) for suspending a weight from the component 10. Such a weight could be used to lower the pipe loop 18 in the wellbore 19 either with or without the sinker bar 16.

Figure 10:
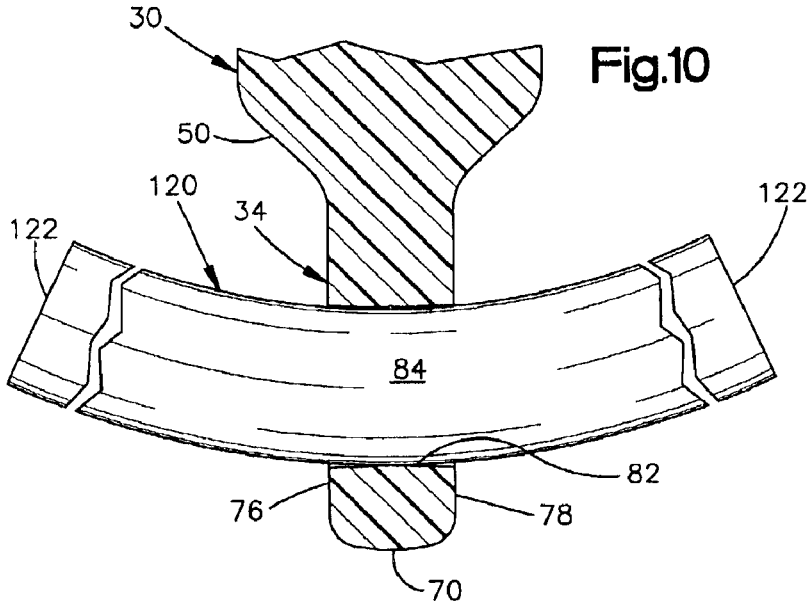
FIG. 10 is a view similar to FIG. 1, showing an alternative arrangements of parts of a wellbore apparatus.

The weight suspension structure 34 may alternatively function as an anchor holder. As shown in FIG. 10, an anchor 120 in the form of a flexible piece of plastic tubing is received through the open bore/eyelet 84. The anchor 120 is curved upwardly so that the opposite ends 122 of the anchor 120 can slide along the surrounding surface 124 (FIG. 1) in the wellbore 19 when the component 10 is moving downward in the wellbore 19, and dig into the surface 124 to restrain movement of the component 10 back upward in the wellbore 19. This is helpful for installing the pipe loop 18 without the use of the sinker bar 16 or a suspended weight.

This written description uses examples to disclose the invention, including the best mode, and also to enable a person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The claimed invention is:

1. An apparatus for use with a sinker bar and a pair of pipes in a wellbore, said apparatus comprising:

a unitary pipe loop component configured for connection to the pair of pipes;

said pipe loop component including a return bend pipe fitting having a fluid flow passage configured to extend between the pipes in the wellbore;

said pipe loop component further including a sleeve having a passage with open opposite ends to receive the sinker bar through said sleeve.

2. An apparatus as defined in claim 1 wherein said unitary pipe loop component is configured for connection to the pair of pipes solely at the lower end surfaces of the pipes.

3. An apparatus as defined in claim 1 wherein said unitary pipe loop component is a one-piece molded plastic part.

4. An apparatus as defined in claim 1 wherein said sleeve has an inner surface with an undulating contour.

5. An apparatus as defined in claim 4 wherein said undulating contour defines a central region of said passage in said sleeve, and further defines separate peripheral regions of said passage in said sleeve.

6. An apparatus as defined in claim 5 wherein said undulating contour defines ribs that extend lengthwise of said passage in said sleeve, with said ribs together defining said central region in the shape of a cylinder radially inward of said ribs, and further defining each of said peripheral regions in the shape of a cylindrical segment extending circumferentially between a respective pair of adjacent ribs.

7. An apparatus as defined in claim 1 wherein said fitting has upper and lower ends, and said sleeve has an upper end which is located vertically between said upper and lower ends of fitting when said fitting is upright.

8. An apparatus as defined in claim 7 wherein said sleeve further has a lower end which is located vertically between said upper and lower ends of said fitting when said fitting is upright.

9. An apparatus as defined in claim 1 wherein said unitary pipe loop component further includes a weight suspension structure configured to suspend a weight from said unitary pipe loop component.

10. An apparatus as defined in claim 9 wherein said weight suspension structure has a knockout portion configured to provide an eyelet through said weight suspension structure.

11. An apparatus for use with a sinker bar and a pair of pipes in a wellbore, said apparatus comprising:

a return bend pipe fitting having a fluid flow passage configured to extend between the pipes in the wellbore; and a sleeve connected to said fitting, said sleeve having a passage with open opposite ends to receive the sinker bar through said sleeve, and further having an inner surface with an undulating contour.

12. An apparatus as defined in claim 11 wherein said undulating contour defines a central region of said passage in said sleeve, and further defines separate peripheral regions of said passage in said sleeve.

13. An apparatus as defined in claim 12 wherein said undulating contour defines ribs that extend lengthwise of said passage in said sleeve, with said ribs together defining said central region in the shape of a cylinder radially inward of said ribs, and further defining each of said peripheral regions in the shape of a cylindrical segment extending circumferentially between a respective pair of adjacent ribs.

14. An apparatus as defined in claim 11 wherein said sleeve and said fitting are parts of a unitary pipe loop component configured for connection to the pipes.

15. An apparatus as defined in claim 14 wherein said unitary pipe loop component is a one-piece molded plastic part.

16. An apparatus for use with a sinker bar and a pair of pipes in a wellbore, said apparatus comprising:

a return bend pipe fitting having a fluid flow passage configured to extend between the pipes in the wellbore; and a sleeve connected to said fitting, said sleeve having a passage with open opposite ends to receive the sinker bar through said sleeve, and further having an outer surface which faces downward, and which has a contour that is inclined upward from a horizontal plane, when said fitting is upright.

17. An apparatus as defined in claim 16 wherein said outer surface of said sleeve is a lower end surface of said sleeve.

18. An apparatus as defined in claim 16 wherein said sleeve has an additional outer surface which faces upward, and which has a contour that is inclined downward from a horizontal plane, when said fitting is upright.

19. An apparatus as defined in claim 18 wherein said additional outer surface is an upper end surface of said sleeve.

20. An apparatus as defined in claim 15 wherein said sleeve and said fitting are parts of a unitary pipe loop component configured for connection to the pipes.

21. An apparatus as defined in claim 19 wherein said unitary pipe loop component is a one-piece molded plastic part.

22. An apparatus as defined in claim 16 wherein said sleeve has an inner surface with an undulating contour.

23. An apparatus for use with a sinker bar in a wellbore, said apparatus comprising: a one-piece molded plastic part including a return bend pipe fitting, a sleeve and a weight suspension structure;

said fitting having a fluid flow passage configured to extend between the pipes in the wellbore; said sleeve having a passage with open opposite ends to receive the sinker bar through said sleeve; and said weight suspension structure being configured to suspend a weight from said one-piece molded plastic part.

24. An apparatus as defined in claim 23 wherein said sleeve has an inner surface with an undulating contour.

25. An apparatus as defined in claim 23 wherein said sleeve has a lower end surface with a contour that is inclined upward from a horizontal plane when said one-piece molded plastic part is upright.

26. An apparatus as defined in claim 23 wherein said sleeve has an upper end surface with a contour that is inclined downward from a horizontal plane when said one-piece molded plastic part is upright.

27. An apparatus as defined in claim 23 wherein said weight suspension structure has a knockout portion configured to provide an eyelet through said weight suspension structure.

* * * * *

UNITED STATES PATENT AND TRADEMARK OFFICE

CERTIFICATE OF CORRECTION

PATENT NO. : 6,920,924 B2
DATED : July 26, 2005
INVENTOR(S) : Roesch et al.

It is certified that error appears in the above-identified patent and that said Letters Patent is hereby corrected as shown below:

Column 6,
Line 15, after "comprising:" begin a new paragraph.
Line 19, after "wellbore;" begin a new paragraph.

Signed and Sealed this

Twenty-second Day of November, 2005

JON W. DUDAS
*Director of the United States Patent and Trademark Office*